US009816057B2

(12) United States Patent
Shellef et al.

(10) Patent No.: US 9,816,057 B2
(45) Date of Patent: Nov. 14, 2017

(54) NONFLAMMABLE COMPOSITION CONTAINING 1,2-DICHLOROETHYLENE

(71) Applicant: Edo Shellef, Great Neck, NY (US)

(72) Inventors: Edo Shellef, Westbury, NY (US); Dov Shellef, Great Neck, NY (US); Richard Degroot, Southfield, MI (US)

(73) Assignee: EDO SHELLEF, Great Neck, NY (US)

( * ) Notice: Subject to any disclaimer, the term of this patent is extended or adjusted under 35 U.S.C. 154(b) by 175 days.

(21) Appl. No.: 14/523,075

(22) Filed: Oct. 24, 2014

(65) Prior Publication Data

US 2016/0115428 A1 Apr. 28, 2016

(51) Int. Cl.
*C11D 7/50* (2006.01)
*B08B 1/00* (2006.01)

(52) U.S. Cl.
CPC ..... *C11D 7/5018* (2013.01); *B08B 1/00* (2013.01)

(58) Field of Classification Search
CPC ..... C11D 7/28; C11D 7/5063; C11D 7/5018; C11D 7/504; C11D 7/509; C11D 11/0047; C11D 7/263; C11D 7/5068
See application file for complete search history.

(56) References Cited

U.S. PATENT DOCUMENTS 6,699,829 B2 * 3/2004 Doyel ..... C11D 7/509 510/202
6,770,614 B2 * 8/2004 Miller ..... C11D 7/261 134/38
6,852,684 B1 * 2/2005 Westbrook ..... C09K 3/30 510/407
7,163,645 B2 1/2007 Hanada et al.
8,163,197 B2 * 4/2012 Schweitzer ..... C11D 7/504 134/1.3
2004/0167053 A1 * 8/2004 Knopeck ..... B08B 3/08 510/405
2004/0224870 A1 * 11/2004 Doyel ..... C11D 7/509 510/412
2007/0203046 A1 * 8/2007 Minor ..... C09K 3/30 510/411
2009/0253820 A1 10/2009 Bowman et al.
2012/0161063 A1 6/2012 Singh
2013/0065044 A1 3/2013 Bowman et al.
2013/0079267 A1 3/2013 Marhold et al.
2013/0244922 A1 * 9/2013 Bartelt ..... C09K 3/30 510/409
2016/0023128 A1 * 1/2016 Uenveren ..... C11D 7/5018 510/365

FOREIGN PATENT DOCUMENTS

WO 2007/109748 A2 9/2007
WO 2009/067720 A2 5/2009
WO 2011/031697 A2 3/2011
WO 2011/041286 A2 4/2011

* cited by examiner

*Primary Examiner* — Gregory Webb
(74) *Attorney, Agent, or Firm* — Oliff PLC

(57) ABSTRACT

A nonflammable solvent composition, a method of cleaning a surface, and a method of coating a substrate with a material using the solvent composition are provided. The nonflammable solvent composition includes about 70 wt. % or more of trans-1,2-dichloroethylene (t-DCE) and about 0.1 to about 30 wt. % of one or more of hydrofluoroether (HFE) and n-propyl bromide. The method of cleaning a surface includes applying the solvent composition to the surface and spreading or rubbing the composition on the surface. The method of coating a substrate with a material includes dissolving one or more material in the solvent composition, applying the solvent composition containing the one or more material to a substrate, and evaporating the solvent composition from the substrate.

20 Claims, No Drawings

NONFLAMMABLE COMPOSITION CONTAINING 1,2-DICHLOROETHYLENE

BACKGROUND

Trans-1,2-dichloroethylene (t-DCE) is a chlorinated solvent with a boiling point of 48° C. that can be used as a cleaner, e.g., cleaning in a vapor degreaser. In particular, t-DCE has good solubilizing power, especially for fatty substances, such as lubricants, oils, and fats. However, its use has been relatively limited for cleaning purposes because, with a flash point of about 2° C. (36° F.), t-DCE is highly flammable.

Prior methods to provide "non-flammable" t-DCE have focused on mixing it with large quantities of a non-flammable compound having a volatility similar to that of t-DCE. For example, such volatile compounds included hydrochlorofluorocarbons (HCFCs), hydrofluorocarbons (HFC's) and the like. These methods relied upon forming azeotropic blends of t-DCE and other components to suppress (raise) the flash point. Such azeotropic mixtures maintain substantially the same composition in the liquid phase and in the vapor phase at the boiling point of the azeotrope. These azeotropic compositions can behave as single solvent degreasing solutions and, as such, are used as solvents in degreasing metal components and cleaning various surfaces in systems where the solvent may be required to continuously evaporate and condensate without fractionation. However, the use of significant proportions of popular HCFC's and HFC's has become disfavored because of their environmental impact: HCFC's have ozone depletion characteristics and non-flammable HFC's are considered "super greenhouse" gases with high global warming potentials.

Other azeotropes and quasi-azeotropes based upon HFC's and t-DCE have been developed. Unfortunately, many HFC's exhibit combinations of properties which are not optimal for safe cleaning. For example, difluoroethane (HFC-152a) and 1,1,1-trifluoropropene (HFO-1243zf) are both flammable and both exhibit very low boiling points. This property makes these azeotropes preferable in applications such as blowing agents, but they are not viable for use in many cleaning applications. Also, although there are distinct advantages to using such azeotropes and quasi-azeotropes, azeotropes and quasi-azeotropes have limited versatility and usefulness as they represent a naturally occurring, fixed ratio of components, sacrificing desirable properties, such as higher solvency, achieved with other ratios of the components. Azeotrope refers to, e.g., a solution of two or more liquids, the composition of which does not change upon distillation.

A need exists, therefore, for a solvent composition that is nonflammable, with a lower environmental impact (i.e., it does not deplete the ozone), and capable of multiple applications (i.e., versatile), in addition to having strong solvency/cleaning power.

SUMMARY

Disclosed herein is a nonflammable solvent composition composed of about 70 wt. % or more of trans-1,2-dichloroethylene (t-DCE) and about 0.1 to about 30 wt. % of one or more of hydrofluoroether (HFE) and n-propyl bromide.

Also disclosed is a method of cleaning a surface using the solvent composition. The method includes applying the solvent composition to the surface and spreading or rubbing the composition on the surface.

The present subject matter also relates to a method of coating a substrate with a material using the solvent composition. The method includes dissolving one or more material in the solvent composition, applying the solvent composition containing the one or more material to a substrate, and evaporating the solvent composition from the substrate.

DETAILED DESCRIPTION OF THE EMBODIMENTS

The compositions described herein are nonflammable, non-azeotropic, environmentally safe, liquid compositions that include t-DCE with a hydrofluoroether (HFE) and/or n-propyl bromide (nPB). The interchangeable or combined use of an HFE and nPB with t-DCE is disclosed herein for providing a nonflammable, non-azeotropic mixture with advantageous solvency characteristics. For instance, the composition may be used for cleaning solid substrates, including dissolving and removing polymers, waxes, and oils from a surface. The present composition may also be used for depositing polymers, waxes, oils, and other lubricants onto a surface.

"Trans-1,2-dichloroethylene" or "t-DCE" refer to, e.g., the trans isomer of an organochloride with the molecular formula, $C_2H_2Cl_2$. T-DCE is a highly flammable solvent, but has exceptional cleaning power and a lower toxicity compared to equivalent chlorinated solvents, such as trichloroethylene, tetrachloroethylene, and methylene dichloride. Despite the high flammability of t-DCE, the present composition is nonflammable even when it contains relatively large amounts of t-DCE with only relatively small amounts of HFE and/or nPB.

The term, "nonflammable," refers to, e.g., the absence of a flash point up to the boiling point of the composition at standard atmospheric pressure as determined in accordance with ASTM D56, or alternatively, satisfaction of the criteria for nonflammability as set forth in ASTM D3065 if the composition is delivered via aerosol.

As used herein, the modifier "about" used in connection with a quantity is inclusive of the stated value and has the meaning dictated by the context. For example, it includes at least the degree of error associated with the measurement of the particular quantity. When used in the context of a range, the modifier "about" should also be considered as disclosing the range defined by the absolute values of the two endpoints. For example, the range "from about 2 to about 4" also discloses the range "from 2 to 4."

The solvent composition may include t-DCE in an amount of about 70 wt. % or more, such as about 70 wt. % to about 99 wt. %, 70 wt. % to about 95 wt. %, about 70 wt. % to about 88 wt. %, about 75 wt. % to about 88 wt. %, about 80 wt. % to about 90 wt. %, and about 80 wt. % to about 88 wt. %.

The composition may also include an HFE. The term, "hydrofluoroether" or "HFE" refers, for example to organic compounds with at least one ether group that includes carbon, hydrogen, fluorine, and oxygen atoms. HFEs are complex organic solvents. In contrast to t-DCE, HFEs are generally poor cleaners, but they are generally nonflammable. Unexpectedly, it has been found that adding even small amounts of an HFE to the composition may render t-DCE nonflammable. The composition may include specific HFEs, such as 1,1,2,2-tetrafluoroethyl 2,2,2-trifluoroethyl ether (HFE-347pc-f; CAS No. 406-78-0), and may include combinations of HFEs. Suitable HFEs are nonflammable and have a boiling point of 45° C. to 80° C.

The solvent composition may also include n-propyl bromide (nPB). "N-propyl bromide" and "nPB" refer to, e.g., an organobromine solvent with the chemical formula $CH_3CH_2CH_2Br$. Like the HFE, nPB may also suppress the flammability of t-DCE. Additionally, nPB is useful as a solvent for the cleaning of solid surfaces.

The solvent composition may contain HFE, nPB, or a combination of HFE and nPB, in an amount of about 0.1 wt. % to about 30 wt. %, such as about 5 wt. % to about 20 wt. %, about 10 wt. % to about 30 wt. %, about 10 wt. % to about 20 wt. %, about 12 wt. % to about 30 wt. %, and about 12 wt. % to about 20 wt. %.

At about a 50:50 ratio, HFE-347 and t-DCE are azeotropic. The present composition, however, is non-azeotropic and does not include azeotropic or quasi-azeotropic mixtures. "Non-azeotropic," refers to, e.g., mixtures that do not maintain substantially the same composition in the liquid phase and in the vapor phase at the boing point of the mixture.

The nonflammable, non-azeotropic composition may be made by mixing or blending t-DCE with HFE and/or nPB. The composition may include a binary blend of t-DCE and HFE or t-DCE and nPB. For example, the composition may include 90 wt. % t-DCE and 10 wt. % HFE, 95 wt. % t-DCE and 5 wt. % nPB, 87 wt. % t-DCE and 13 wt. % HFE, 85 wt. % t-DCE and 15 wt. % HFE, or 83 wt. % t-DCE and 17 wt. % HFE. Alternatively, the composition may include a tertiary blend of t-DCE, HFE, and nPB. For example, the composition may include a tertiary blend of 88 wt % t-DCE, 7 wt. % HFE, and 5 wt. % nPB, or 91.5 wt. % t-DCE, 3.5 wt. % HFE, and 5 wt. % nPB. Various amounts of t-DCE, HFE-347, and nPB were tested to determine the flash point in different compositions. The results are shown in Tables 1 and 2 below.

TABLE 1

| Example | t-DCE wt. % | HFE wt. % | Flash Point ° F. (° C.) |
|---|---|---|---|
| 1 | 83 | 17 | None |
| 2 | 85 | 15 | None |
| 3 | 87 | 13 | None |
| 4 | 88 | 12 | None |
| 5 | 89 | 11 | None |
| 6 | 90 | 10 | None |
| 7 | 91 | 9 | 64 (17.78) |
| 8 | 93 | 7 | 60 (15.56) |
| 9 | 95 | 5 | 60 (15.56) |

TABLE 2

| Example | t-DCE wt. % | HFE wt. % | nPB wt. % | Flash Point ° F. (° C.) |
|---|---|---|---|---|
| 10 | 88 | 7 | 5 | None |
| 11 | 91.5 | 3.5 | 5 | None |
| 12 | 95 | 0 | 5 | None |

As shown in Tables 1 and 2, by incorporating only small amounts of HFE and/or nPB, t-DCE is rendered nonflammable (i.e., does not exhibit a flash point up to the boiling point of the composition), thereby enabling use of the exceptional combination of cleaning power and low toxicity that t-DCE has. In other words, the present compositions exploit the most favorable properties of each of the components. For instance, t-DCE greatly expands the range of cleaning power of HFE and HFE in turn makes the use of t-DCE safer, and while nPB increases the solvency of t-DCE, the t-DCE in turn increases the versatility because of its higher recommended exposure. As a result, various combinations of t-DCE with HFE and/or nPB produce versatile and nonflammable solvent compositions. Furthermore, because the present compositions are non-azeotropic, the amounts of each component may be adjusted to increase or decrease the solvency, thus either improving the composition's use as a cleaner and carrier solvent, or improving the composition's compatibility with a wider array of substrates.

Although the compositions in Examples 7-9 are marginally flammable as they exhibit a flash point at 60° F. or 64° F., the addition of a small fraction of a nonflammable additive, such as a lubricant or coating, may render the compositions non-flammable.

In some embodiments, the composition can consist solely of (i) t-DCE and (ii) HFE and/or nPB. The composition may also optionally contain other components that do not materially affect the composition's non-flammability or its exceptional cleaning power. For example, various known alcohols and solvents may also be included in the composition in small quantities. Known alcohols and solvents include methanol, ethanol, isopropanol, n-butanol, isooctanol, methyl isobutyl carbinol, isoamyl alcohol, isobutyl alcohol, tert butyl alcohol, cyclohexanol, methyl cyclohexanol, benzyl alcohol, benzoic acid, furfuryl alcohol, and the like. These optional components may be present in an amount of less than about 10 wt. %. More specifically, these optional components may be present in an amount of about 0.01 wt. % to about 5 wt. %, about 0.1 wt. % to about 3 wt. %, or about 0.1 wt. % to about 1 wt. %.

The composition may be used as a cleaning solvent in, e.g., cold cleaning or wipe cleaning, or as a carrier solvent in, e.g., coatings and depositions. To clean a surface, the composition may be applied to the surface and spread or rubbed on the surface to remove contaminants from the surface. The composition may be applied as a cleaning solvent in cold cleaning applications via a parts washer, any batch loaded, non-boiling degreaser, sprays, aerosols, and the like. The composition may also be applied through wipe cleaning, by using a wetted rag or other absorbent material coupled with rubbing to remove contaminants from materials. The composition may be used as a cleaning solvent for solid substrates including electronic and mechanical parts, photographic film, molds for casting plastics, surfaces being prepared for painting, fabrics, animal hides, metal, glass, ceramic, stone or stone-like materials such as concrete, wood, natural fibers, synthetic fibers, PVC pipes, and optical lenses. The composition may be used to remove from solid substrates a variety of contaminants, such as greases, oils, waxes, or polymers. The composition may be used to remove relatively heavy motor oil and lighter weight oils such as machine oils or other light-weight lubricants such as silicone or Teflon® polytetrafluoroethylene (PTFE). Alternatively, the composition may be used to clean solid chemicals insoluble in the composition.

Circuit boards, commonly used in electronic appliances, such as televisions and computers, are often contaminated with solder flux in the assembly process. Solder flux is a grease-like substance that is either applied to the surface of the board before soldering, or is contained in the core of the solder itself, in order to help the solder retain heat and spread onto a surface. This sticky flux residue must then be removed from the surface of the circuit board. Various techniques may be employed to clean these multi-faceted surfaces with a solvent, e.g., spraying or brushing, as mentioned above.

The compositions may be used to clean electronic components such as integrated circuits or silicon chips. For example, it is necessary to clean silicon chips are manufacturing simply to remove any possible contamination, as these delicate parts must be absolutely clean.

The composition may be used to clean various types of photographic films including polyester base film. Photographic films are composed of an emulsion layer, containing photosensitive silver-halide particles, spread upon a base material. The base material may be either an acetate or polyester base. A polyester base is useful since it is far more durable and scratch-resistant than an acetate base film which is commonly used for film negatives. Some common contaminants on film are dust, lint and fingerprints. Photographic film may be cleaned by immersing the film in a bath of solvent comprising the non-azeotropic composition. The photographic film may also be dried by, e.g., a jet of warm air, to help evaporate the solvent from the film surface. Alternatively, the film could be buffing with a lint-free material that has been moistened with the non-azeotropic composition.

The composition may also be used as a carrier solvent in applications including lubricants, penetrants, coatings, and surface protectants. More specifically, the composition may be used for dissolving materials including polymers, waxes, oils, other lubricants, paints, pesticides, insecticides, and fungicides, and for removing these substances from, or delivering these substances to a surface. That is, after the composition dissolves any of the above materials, these materials may be reconstituted on any number of surfaces for the purpose of providing a coating.

First, a material or substance may be dissolved in the present non-azeotropic solvent. Then, this liquid is applied to a substrate by dipping, brushing, or spraying, including aerosol spraying. Next, the present solvent evaporated from the substrate by heating, or by the natural evaporation tendencies of the solvent. The polymers, waxes, oils or paints are then left behind upon the substrate in an even, thorough coating.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A solvent composition comprising:

about 70 wt. % or more of trans-1,2-dichloroethylene (t-DCE); and about 0.1 to about 17 wt. % of one or more of 1,1,2,2-tetrafluoroethyl 2,2,2-trifluoroethyl ether (HFE) and n-propyl bromide;

wherein the composition is non-azeotropic.

2. The composition according to claim 1, wherein the t-DCE is present in an amount of about 70 wt. % to about 95 wt. %.

3. The composition according to claim 1, wherein the one or more of HFE and n-propyl bromide is present in an amount of about 5 wt. % to about 17 wt. %.

4. The composition according to claim 2, wherein the one or more of HFE and n-propyl bromide is present in an amount of about 5 wt. % to about 17 wt. %.

5. The composition according to claim 1, wherein the t-DCE is present in an amount of about 70 wt. % to about 90 wt. % and the one or more of HFE and n-propyl bromide is present in an amount of about 10 wt. % to about 17 wt. %.

6. The composition according to claim 1, wherein the composition exhibits no flash point.

7. The composition according to claim 1, wherein the composition does not exhibit a flash point up to a boiling point of the composition.

8. A solvent composition comprising:

about 70 wt. % or more of trans-1,2-dichloroethylene (t-DCE); and about 0.1 to about 20 wt. % of one or more of 1,1,2,2-tetrafluoroethyl 2,2,2-trifluoroethyl ether (HFE) and n-propyl bromide;

wherein the composition is non-azeotropic.

9. A method of cold cleaning a surface comprising:

applying a solvent composition to the surface; and spreading or rubbing the composition on the surface to cold clean the surface;

wherein:

the solvent composition comprises about 70 wt. % or more of trans-1,2-dichloroethylene (t-DCE), and about 0.1 to about 30 wt. % of one or more of 1,1,2,2-tetrafluoroethyl 2,2,2-trifluoroethyl ether (HFE) and n-propyl bromide; and the solvent composition is non-azeotropic.

10. The method claim 9, wherein the solvent composition is applied to the surface by one or more selected from the group consisting of brushes, wipes, aerosols, and sprays.

11. The method of claim 9, wherein the surface has one or more contaminants selected from the group consisting of a polymer, grease, oil, wax, and lubricant, which are removed from the surface upon spreading or rubbing the composition on the surface.

12. The method of claim 11, wherein the solvent composition dissolves the one or more contaminants.

13. A method of coating a substrate with a material comprising:

dissolving one or more material in the solvent composition of claim 1;

applying the solvent composition containing the one or more material to a substrate; and evaporating the solvent composition from the substrate.

14. The method according to claim 13, wherein the material comprises one or more of a polymer, wax, oil, lubricant, paint, pesticide, insecticide, and fungicide.

15. The method according to claim 13, wherein the solvent composition containing the one or more material is applied to the substrate by one or more of dipping, brushing, and spraying.

16. The method according to claim 13, wherein the solvent composition is evaporated from the substrate by heating.

17. The solvent composition according to claim 1, wherein the composition is nonflammable.

18. The solvent composition according to claim 8, wherein the composition is nonflammable.

19. The method according to claim 9, wherein the solvent composition is applied to the surface by aerosol.

20. The method according to claim 9, wherein the one or more of HFE and n-propyl bromide is present in the solvent composition in an amount of about 0.1 to about 17 wt. %.

* * * * *